United States Patent [19]

Smith

[11] 4,061,107

[45] Dec. 6, 1977

[54] CLICKER FOR INDICATING POSITION OF ARROW

[76] Inventor: Wilbur J. Smith, 133 E. Victory, Phoenix, Ariz. 85040

[21] Appl. No.: 740,817

[22] Filed: Nov. 11, 1976

[51] Int. Cl.[2] ..... G08B 3/00

[52] U.S. Cl. ..... 116/67 R; 124/23 R; 124/41 A

[58] Field of Search ..... 124/88, 86, 80; 116/14, 116/67 R, DIG. 34, 114 H

[56] References Cited

U.S. PATENT DOCUMENTS

| | | | |
|---|---|---|---|
| 3,097,624 | 7/1963 | Bergquist | 124/23 R |
| 3,443,558 | 5/1969 | Peck | 124/24 R |
| 3,499,414 | 3/1970 | Frydenlund | 124/23 R X |
| 3,518,959 | 2/1970 | Bunker | 116/67 R |
| 3,669,059 | 6/1972 | Stuart | 124/88 X |
| 3,678,880 | 7/1972 | Richardson et al. | 116/67 |
| 3,866,592 | 2/1975 | Carella | 124/86 X |

*Primary Examiner*—William H. Grieb
*Assistant Examiner*—William R. Browne
*Attorney, Agent, or Firm*—Warren F. B. Lindsley

[57] ABSTRACT

A sounding device for a bow and arrow which emits a detachable signal when the bow has been drawn to a desired limit for releasing the arrow.

The signal device comprises elongated resilient member adjustably positionable on the bow, which is held in tension over the arrow shaft and slidably holds the arrow against a guide rest when the bow is drawn and which is released to abut the guide rest, generating an audible sound when the arrow shaft is drawn beyond it.

6 Claims, 6 Drawing Figures

CLICKER FOR INDICATING POSITION OF ARROW

BACKGROUND OF THE INVENTION

This invention relates to bows and arrows and, more particularly, to those having a signal device indicating when the bow string has been drawn a given distance.

The clicker is a device for checking the draw of an arrow, that is, it tells the archer when an arrow has been fully drawn, thus, assuring that each arrow will be drawn back exactly the same distance for each shot. Uniform draw for each shot is, of course, especially important at longer distances where a minute variance in the length of the draw will have a very substantial effect on the cast of the arrow. Clickers have achieved widespread use in the target archery field because of the beneficial effect in preventing flinching, and underdrawing and assuring uniform draw for each shot.

Basically, the known clickers for use with target arrows comprise a simple spring steel clicker arm attached at its upper end to the side of the shooting window of the archery bow. The lower end of the clicker arm extends downwardly adjacent the arrow rest and is flexed outwardly slightly to engage the side of the arrow opposite the bow. The arm remains engaged against the outside of the arrow as the arrow is being drawn, until the tip of the arrow is drawn rearwardly past the clicker arm whereupon the arm snaps back against the side of the bow to produce an audible "click". This tells the archer that the arrow has been drawn the proper distance and should be released.

In actual practice, many of the experts employ the known target clicker not only as a draw check, but also as a mental triggering device by training to release the arrow immediately upon hearing the "click". Since the archer does not know exactly when the click will occur, he does not anticipate reaching full draw and, thus, prevents flinching, which is a common fault among archers.

There have been prior art devices serving as draw checks and employing trigger signalling means, such as those shown and described in U.S. Pat. Nos. 3,443,558; 3,499,414; and 3,518,959, but none of them are designed to easily adjust or compensate for varying target distances.

A skilled hunter or sportsman will use a bow which he is capable of drawing to the fullest extent possible, and the greater the speed he can impart to the traveling arrow, the straighter the arrow trajectory. However, since the force of gravity will necessarily cause the arrow trajectory to arch toward the earth no matter what the arrow speed, the skilled bow user will make judgments as to the distance from the target and compensate for his arch by aiming the arrow above the target. This compensation can also be accomplished by varying the distance the bow is drawn.

Accordingly, a need exists for a clicker which holds the shaft against the bow when the bow is drawn and indicates when it has been drawn a given distance that may be readily adjustable to indicate different distances of bow string draw to compensate in a repeatable manner for varying target distances.

SUMMARY OF THE INVENTION

In order to obviate the disadvantages and incapabilities of presently available clickers, a new and improved arrow actuated clicker for archery bow is provided which is light in weight, extremely simple in design and inexpensive to manufacture and which may be quickly and easily attached or detached from the side surfaces of a conventional archery bow.

Accordingly, an improved clicker is provided employing a resilient means disposed on the side of the bow above the hand and in the arrow area for engaging the arrow shaft to hold the arrow against the bow. The arrow is so held until the arrow head passes, thereby releasing the resilient means causing a click to sound as a signal for the archer to release the string and arrow.

The resilient means of the clicker is adjustably mounted on the bow in a novel manner for selectively and repeatedly changing the draw of the arrow to compensate for varying target distances for positioning the arrowhead for the particular target distance to be shot.

It is, therefore, one object of this invention to provide an improved arrow actuated clicker for archery bows.

Another object of this invention is to provide an improved arrow actuated clicker for archery bows which may be easily adjusted repeatedly to compensate for varying target distances.

A further object of this invention is to provide an improved arrow actuated clicker for archery bows comprising a minimum number of component parts.

Further objects and advantages of the invention will become apparent as the following description proceeds and the features of novelty which characterize this invention will be pointed out with particularity in the claims annexed to and forming a part of this specification.

DESCRIPTION OF THE PREFERRED EMBODIMENTS

Figure 1:
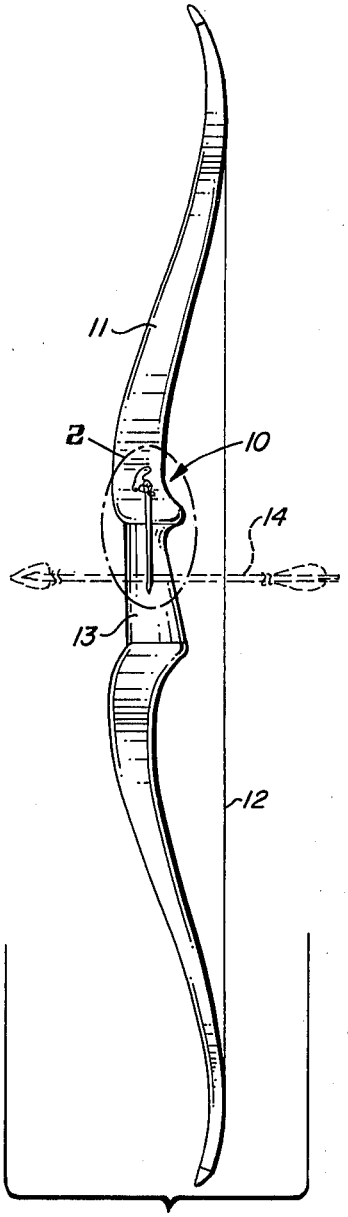
FIG. 1 is a side elevational view of a conventional archery bow showing the arrow actuated clicker of the present invention attached to one side of the bow and supporting a conventional arrow with the untensed bowstring positioned in the neck of the arrow in readiness for the initial draw and tension of the bowstring.

Referring more particularly to the drawing by characters of reference, FIGS. 1–5 disclose an arrow actuated clicker 10 embodying the invention as it would appear when attached in the proper location at the spine-point of an archery bow 11, i.e., where an arrow would normally contact the side of a bow. The archery bow 11 is provided with the usual bowstring 12 and a contoured hand grip portion 13 that is located just below the spine-point of the bow for supporting a shaft 14 of a conventional arrow 15.

The detailed construction of the arrow actuated clicker is illustrated in FIGS. 3–6, and its component parts include an attachment plate 16 which is suitably fastened to bow so as to position a dependent resilient member or spring arm 17 in the path of movement of the shaft 14 of arrow 15 when it is moved during a drawing action of the bowstring 12.

Figure 2:
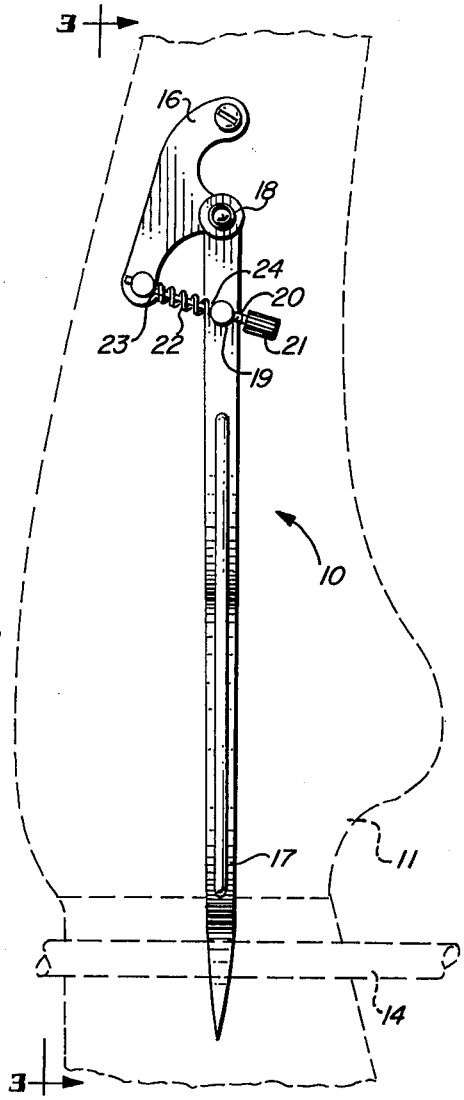
FIG. 2 is an enlarged fragmentary side elevation of that portion of the bow to which the arrow actuated clicker is attached as indicated by the encirclement of the area "2" in FIG. 1 and showing in greater detail the associated details of the clicker.
Figure 3:
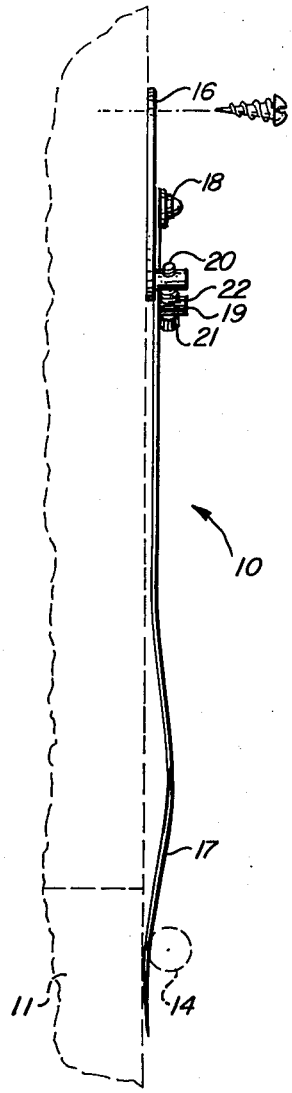
FIG. 3 is an enlarged fragmentary sectional view taken along line 3—3 of FIG. 2.
Figure 4:
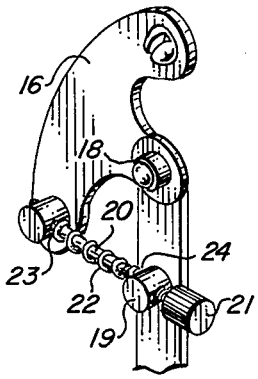
FIG. 4 is an enlarged perspective view of the arrow actuated clicker.
Figure 5:
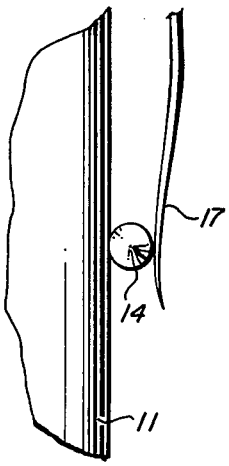
FIG. 5 is an enlarged fragmentary sectional view similar to FIG. 3 showing the relationship of the arrow shaft to the resilient biasing means of the clicker in its shaft biasing position.
Figure 6:
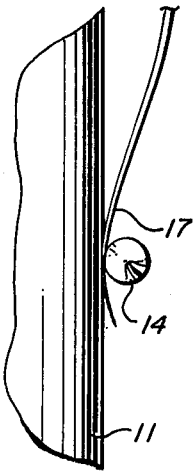
FIG. 6 is an enlarged fragmentary sectional view similar to FIG. 4 showing the relationship of the resilient means of clicker after it has released the shaft and made its clicking sound against the adjacent flat surface of the bow.

As shown in FIGS. 2 and 3 of the drawing, plate 16 is bolted or screwed to the bow but it should be recognized that suitable adhesive means may be used for this purpose, if so desired.

One arm of plate 16 is provided with a bearing means, such as an outwardly projecting lug 18 for pivotally mounting one end of spring arm 17.

Spring arm 17 has attached to its surface at a point adjacent its connection to lug 18 a sleeve 19, which is able to ride in sliding relationship on a shaft 20, one end of which is pivotally connected to plate 16 at a point spaced from lug 18 and the other end of which is threadily connected to an adjustment knob 21. A spring 22 is coiled around shaft 20 and has one end 23 abutting the connection of shaft 20 to plate 16 and the other end 24 abutting the juxtapositioned surface of sleeve 19.

As knob 21 is threadily moved along shaft 20 compressing spring 22, the tip 25 of the spring arm 17 is moved toward the left of the bow as shown in FIGS. 1 and 2. As knob 21 is threadily moved toward the end of shaft 20, the tension on the spring is relaxed, causing the spring to move the pointed end 25 of the spring arm to the right as shown in FIGS. 1 and 2 of the drawing.

As noted from FIG. 3 of the drawing, the lower portion of spring arm 17 is curved away from the bow in a concave configuration with its tip 25 biased against the bow so that when the shaft of an arrow is placed between the spring arm and the bow the lip 25 of the spring arm will engage under tension the shaft of the arrow, and it is drawn past the bow. The spring arm is made of suitable resilient material so as to cause the arm to spring back to its usual arcuate unstressed position when it releases an arrow.

The tension of spring 22 keeps the spring arm 17 in a set position against knob 21 in the manner known in the art.

The above description is an example only of one embodiment of the invention. It should be recognized that the pivoted connection of shaft 20 to plate 16 may occur at any position on the plate and extend between it and the spring arm at one of a plurality of positions along spring arm 17, other than the position shown, and still be within the scope of the invention.

It should be known that the invention is particularly directed to the feature of easily and quickly adjustably positioning the tip 25 of the spring arm 17 to one of many positions by simply threadily or slidably moving the knob 21 along shaft 20 to compensate for varying target distances.

Although but one embodiment of the invention has been illustrated and described, the appended claims are intended to cover and embrace any and all modifications which fall within the spirit and scope of the invention.

What is claimed is:

1. An arcuate bow draw check clicker comprising:

a plate mountable on the side of a bow in the arrow area, an audible signal generating means comprising an extended arm and having a pointer end disposed to engage the shaft of an arrow, said generating means being pivotally mounted at one end thereof on said plate for generating a noise to indicate to an archer that a predetermined drawing distance of an arrow along a bow has been reached, shaft means having one end pivotally mounted on said plate at a position spaced from the pivotal connection of said arm to said plate, the other end of said shaft means being slidably mounted on said arm for moving laterally thereof, tension means mounted on said shaft means and arranged to extend between said plate and the point of engagement with said arm for biasing said arm in a given direction, and adjustment means mounted on the other end of said shaft means for varying the length of that portion of the shaft means between said plate and its point of engagement with said arm for varying the position of the pointer end of said arm on a bow.

2. The archery bow draw check clicker set forth in claim 1 wherein:

said arm comprises an arcuate configuration the pointer end of which is resiliently braced when mounted on a bow toward the arrow rest of a bow.

3. The archery bow draw check clicker set forth in claim 1 wherein:

the adjustment means comprises a knob threadily mounted on said other end of said shaft means.

4. The archery bow draw check clicker set forth in claim 1 wherein:

said tension means comprises a coil spring surrounding said shaft means.

5. The archery bow draw check clicker set forth in claim 1 wherein:

the slidable connection of said shaft means to said arm comprises a sleeve mounted on said arm having passageway extending therethrough, and said tension means extends between said plate and the surface of said sleeve.

6. The archery bow draw check clicker set forth in claim 1 wherein:

the point of slidable connection of said shaft means to said arm occurs at a position adjacent said one end of said arm.

* * * * *